US006416158B1

(12) United States Patent
Floyd et al.

(10) Patent No.: US 6,416,158 B1
(45) Date of Patent: Jul. 9, 2002

(54) BALLISTIC AEROSOL MARKING APPARATUS WITH STACKED ELECTRODE STRUCTURE

(75) Inventors: Philip D. Floyd, Sunnyvale; Tuan Anh Vo, Hawthorne; Kaiser H. Wong, Torrance; Gregory B. Anderson, Woodside; Eric Peeters, Fremont, all of CA (US); Jaan Noolandi, Mississauga (CA); Meng H. Lean, Briarcliff Manor, NY (US); Armin R. Volkel, Mississauga (CA); John E. Northrup, Palo Alto, CA (US); Jurgen Daniel, Mountain View, CA (US); G. A. Neville Connell, Alpine, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/407,908

(22) Filed: Sep. 29, 1999

Related U.S. Application Data

(63) Continuation-in-part of application No. 09/163,893, filed on Sep. 30, 1998.

(51) Int. Cl.[7] ..... B41J 2/035
(52) U.S. Cl. ..... 347/21
(58) Field of Search ..... 347/20, 21, 43, 347/46, 54, 55, 65, 67, 94

(56) References Cited

U.S. PATENT DOCUMENTS

| | | | | |
|---|---|---|---|---|
| 2,573,143 | A | 10/1951 | Jacob | 178/5.2 |
| 2,577,894 | A | 12/1951 | Jacob | 346/75 |
| 3,152,858 | A | 10/1964 | Wadey | 346/75 |
| 3,572,591 | A | 3/1971 | Brown | 239/337 |

(List continued on next page.)

FOREIGN PATENT DOCUMENTS

| | | | |
|---|---|---|---|
| EP | 0 655 337 | A2 | 5/1995 |
| EP | 0 726 158 | A1 | 8/1996 |
| JP | 53035539 | A | 4/1978 |
| JP | 353035539 | A | 4/1978 |
| JP | 55 019556 | | 2/1980 |
| JP | 55 028819 | | 2/1980 |
| JP | 56 146773 | | 11/1981 |
| JP | 57-192027 | A * | 11/1982 |
| JP | 58-224760 | | 12/1983 |
| JP | 60 229764 | | 11/1985 |
| JP | 362035847 | A | 2/1987 |
| JP | 02 293151 | | 12/1990 |
| JP | 4-158044 | | 6/1992 |
| JP | 4-182138 | | 6/1992 |
| JP | 5-4348 | | 1/1993 |
| JP | 5-193140 | | 8/1993 |
| JP | 5-269995 | | 10/1993 |
| WO | WO 93/11866 | | 6/1993 |
| WO | WO 94/18011 | | 8/1994 |
| WO | WO 97/01449 | | 1/1997 |
| WO | WO 97/27058 | | 7/1997 |

OTHER PUBLICATIONS

US 5,828,388, 10/1998, Clearly et al. (withdrawn)

F. Anger, Jr. et al. Low Surface Energy Fluoro–Epoxy Coating for Drop–on–Demand Nozzles, IBM Technical Disclosure Bulletin, vol. 26, No. 1, p. 431, Jun. 1983.

(List continued on next page.)

*Primary Examiner*—Anh T. N. Vo

(57) ABSTRACT

A device for the transport and/or metering of marking material includes a plurality of phased electrodes, for example formed on a substrate. An electrostatic traveling wave may be generated along the electrodes to sequentially attract particles of marking material, and thereby transport them to a desired location. The electrodes may be formed in a planar structure. A matrix interconnection scheme allows for reduced lead count.

22 Claims, 12 Drawing Sheets

U.S. PATENT DOCUMENTS 3,977,323 A 8/1976 Pressman et al. ..... 101/426
3,997,113 A 12/1976 Peenbaker, Jr. ..... 239/15
4,019,188 A 4/1977 Hochberg et al. ..... 346/75
4,106,032 A 8/1978 Miura et al. ..... 347/21
4,113,598 A 9/1978 Jozwiak, Jr. et al. ... 204/181 R
4,146,900 A 3/1979 Arnold ..... 347/21
4,171,777 A 10/1979 Behr ..... 239/422
4,189,937 A 2/1980 Nelson ..... 73/28
4,196,437 A 4/1980 Hertz ..... 347/98
4,223,324 A 9/1980 Yamamori et al. ..... 347/21
4,265,990 A 5/1981 Stolka et al. ..... 430/59
4,271,100 A 6/1981 Trassy ..... 261/78 A
4,284,418 A 8/1981 Andres ..... 55/16
4,368,850 A 1/1983 Szekely ..... 239/333
4,403,228 A 9/1983 Miura et al. ..... 346/75
4,403,234 A 9/1983 Miura et al. ..... 347/21
4,480,259 A 10/1984 Kruger et al. ..... 347/63
4,490,728 A 12/1984 Vaught et al. ..... 347/60
4,500,895 A 2/1985 Buck et al. ..... 347/87
4,514,742 A 4/1985 Suga et al.
4,515,105 A 5/1985 Danta et al. ..... 118/629
4,523,202 A 6/1985 Gamblin ..... 346/75
4,544,617 A 10/1985 Mort et al. ..... 430/58
4,606,501 A 8/1986 Bate et al. ..... 239/346
4,607,267 A 8/1986 Yamamuro ..... 347/51
4,613,875 A 9/1986 Le et al. ..... 347/21
4,614,953 A 9/1986 Lapeyre ..... 347/43
4,634,647 A 1/1987 Jansen et al. ..... 430/84
4,647,179 A 3/1987 Schmidlin ..... 355/3 DD
4,663,258 A 5/1987 Pai et al. ..... 430/57
4,666,806 A 5/1987 Pai et al. ..... 430/57
4,683,481 A 7/1987 Johnson ..... 347/65
4,720,444 A 1/1988 Chen ..... 430/58
4,728,969 A 3/1988 Le et al. ..... 347/21
4,741,930 A 5/1988 Howard et al. ..... 427/265
4,760,005 A 7/1988 Pai ..... 430/65
4,770,963 A 9/1988 Pai et al. ..... 430/64
4,791,046 A * 12/1988 Ogura ..... 430/296
4,839,232 A 6/1989 Morita et al. ..... 428/473.5
4,839,666 A 6/1989 Jayne ..... 346/75
4,870,430 A 9/1989 Daggett et al. ..... 347/88
4,882,245 A 11/1989 Gelorme et al. ..... 430/14
4,896,174 A 1/1990 Stearns ..... 346/459
4,929,968 A 5/1990 Ishikawa ..... 347/21
4,961,966 A 10/1990 Stevens et al. ..... 427/299
4,973,379 A 11/1990 Brock et al. ..... 156/640
4,982,200 A 1/1991 Ramsay ..... 346/75
5,030,536 A 7/1991 Pai et al. ..... 430/127
5,041,849 A 8/1991 Quate et al. ..... 347/46
5,045,870 A 9/1991 Lamey et al. ..... 346/140 R
5,063,655 A 11/1991 Lamey et al. ..... 29/611
5,066,512 A 11/1991 Goldowsky et al. ..... 427/14.1
5,113,198 A 5/1992 Nishikawa et al. ..... 347/21
5,190,817 A 3/1993 Terrell et al. ..... 428/343
5,202,704 A 4/1993 Iwao ..... 347/55
5,208,630 A 5/1993 Goodbrand et al. ..... 355/201
5,209,998 A 5/1993 Kavassalis et al. ..... 430/106
5,240,153 A 8/1993 Tubaki et al. ..... 222/385
5,240,842 A 8/1993 Mets ..... 435/172.3
5,294,946 A 3/1994 Gandy et al. ..... 347/3
5,300,339 A 4/1994 Hays et al. ..... 428/36.9
5,350,616 A 9/1994 Pan et al. ..... 428/131
5,363,131 A 11/1994 Momose et al. ..... 347/46
5,385,803 A 1/1995 Duff et al. ..... 430/138
5,397,664 A * 3/1995 Noelscher et al. ..... 430/5
5,403,617 A 4/1995 Haaland ..... 427/180
5,425,802 A 6/1995 Burton et al. ..... 95/32
5,426,458 A 6/1995 Wenzel et al. ..... 347/45
5,428,381 A 6/1995 Hadimioglu et al. ..... 347/46
5,482,587 A 1/1996 McAleavey ..... 156/243
5,491,047 A * 2/1996 Kim et al. ..... 430/329
5,510,817 A 4/1996 Sohn ..... 347/21
5,512,712 A 4/1996 Iwata et al. ..... 174/258
5,520,715 A 5/1996 Oeftering ..... 75/335
5,522,555 A 6/1996 Poole ..... 241/33
5,535,494 A 7/1996 Plesinger et al. ..... 29/25.35
5,541,625 A 7/1996 Holstun et al. ..... 347/5
5,554,480 A 9/1996 Patel et al. ..... 430/137
5,600,351 A 2/1997 Holstun et al. ..... 347/40
5,604,519 A * 2/1997 Keefe et al. ..... 347/13
5,635,969 A 6/1997 Allen ..... 347/96
5,640,187 A 6/1997 Kashiwazaki et al. ..... 347/101
5,646,656 A * 7/1997 Leonhardt et al. ..... 347/43
5,654,744 A 8/1997 Nicoloff, Jr. et al. ..... 347/43
5,678,133 A 10/1997 Siegel ..... 399/67
5,682,190 A 10/1997 Hirosawa et al. ..... 347/94
5,712,669 A 1/1998 Swanson et al. ..... 347/49
5,717,986 A 2/1998 Vo et al. ..... 399/291
5,731,048 A 3/1998 Ashe et al. ..... 427/585
5,756,190 A 5/1998 Hosomi et al. ..... 428/209
5,761,783 A 6/1998 Osawa et al. ..... 29/25.35
5,777,636 A 7/1998 Naganuma et al. ..... 347/10
5,780,187 A * 7/1998 Pierrat ..... 430/5
5,787,558 A 8/1998 Murphy ..... 29/25.35
5,818,477 A 10/1998 Fullmer et al. ..... 347/43
5,853,906 A 12/1998 Hsieh ..... 428/690
5,882,830 A 3/1999 Visser et al. ..... 430/59
5,893,015 A 4/1999 Mojarradi et al. ..... 399/291
5,900,898 A 5/1999 Shimizu et al. ..... 347/93
5,958,122 A 9/1999 Fukuda et al. ..... 106/31.57
5,967,044 A * 10/1999 Marschke ..... 101/363
5,968,674 A 10/1999 Hsieh et al. ..... 428/690
5,969,733 A 10/1999 Sheinman ..... 347/75
5,981,043 A 11/1999 Murakami et al. ..... 428/209
5,982,404 A 11/1999 Iga et al. ..... 347/173
5,990,197 A 11/1999 Escano et al. ..... 523/160
5,992,978 A * 11/1999 Fujii et al. ..... 347/54
6,019,466 A 2/2000 Hermanson ..... 347/104
6,036,295 A 3/2000 Ando et al. ..... 347/7
6,081,281 A 6/2000 Cleary et al. ..... 347/21
6,116,718 A 9/2000 Peeters et al. ..... 347/21

OTHER PUBLICATIONS

N. A. Fuchs. The Mechanics of Aerosols, Dover Publications, Inc., p. 79, 367–377, 1989 (Originally published in 1964 by Pergamon Press Ltd).

Hue Le et al. Air–Assisted Ink Jet with Mesa–Shaped Ink–Drop–Forming Orifice, Presented at the Fairmont Hotel in Chicago and San Jose, Fall 1987, p. 223–227.

No author listed, Array Printers Demonstrates First Color Printer Engine, The Hard Copy Observer Published by Lyra Research, Inc., vol. VIII, No. 4, p. 36, Apr. 1998.

U. S. Application No. 09/041,353, Coated Photographic Papers, Filed Mar. 12, 1998.

U. S. Application No. 09/410,371, Ballistic Aerosol Marking Apparatus with Non–Wetting Coating, Filed Sep. 30, 1999.

U. S. Application No. 09/164,124 (Attorney Docket D/98314Q1) entitled "Method of Marking a Substrate Employing a Ballistic Aerosol Marking Apparatus" to Eric Peeters et al., filed Sep. 30, 1998.

U. S. Application No. 09/163,839 (Attorney Docket D/98409) entitled "Marking Material Transport" to Tuan Anh Vo et al., filed Sep. 30, 1998.

U. S. Application No. 09/163,954 (Attorney Docket D/98562) entitled Ballistic Aerosol Marking Apparatus for Marking with a Liquid Material to Eric Peeters et al., filed Sep. 30, 1998.

U. S. Application No. 09/163,924 (Attorney Docket D/98562Q1) entitled "Method for Marking with a Liquid Material Using a Ballistic Aerosol Marking Apparatus" to Eric Peeters et al., filed Sep. 30, 1998.

U. S. Application No. 09/163,799 (Attorney Docket D/98565Q1) entitled "Method of Making a Print Head for Use in a Ballistic Aerosol Marking Apparatus" to Eric Peeters et al., filed Sep. 30, 1998.

U. S. Application No. 09/163,664 (Attorney Docket No. D/98566) entitled "Organic Overcoat for Electrode Grid" to Kaiser H. Wong et al., filed Sep. 30, 1998.

U. S. Application No. 09/163,518 (Attorney Docket No. D/98577) entitled "Inorganic Overcoat for Particulate Transport Electrode Grid" to Kaiser H. Wong et al., filed Sep. 30, 1998.

U. S. Application No. 09/164,104 (Attorney Docket D/98564) "Kinetic Fusing of a Marking Material" to Jaan Noolandi et al., filed Sep. 30, 1998.

U. S. Application No. 09/163,825 (Attorney Docket D/98563) entitled "Multi–Layer Organic Overcoat for Electrode Grid" to Kaiser H. Wong, filed Sep. 30, 1998.

U. S. Application No. 09/164,250 (Attorney Docket D/98314Q2) entitled "Ballistic Aerosol Marking Apparatus for Treating a Substrate" to.Eric Peeters et al., filed Sep. 30, 1998.

U. S. Application No. 09/163,808 (Attorney Docket D/98314Q3) entitled "Method of Treating a Substrate Employing a Ballistic Aerosol Marking Apparatus" to Eric Peeters et al, filed Sep. 30, 1998.

U. S. Application No. 09/163,765 (Attorney Docket D/98314Q4) entitled "Cartridge for Use in a Ballistic Aerosol Marking Apparatus" to Eric Peeters et al., filed Sep. 30, 1998.

* cited by examiner

BALLISTIC AEROSOL MARKING APPARATUS WITH STACKED ELECTRODE STRUCTURE

CROSS-REFERENCE TO RELATED APPLICATIONS

This is a CIP application of U.S. Ser. No. 09,163,893 filed of Sep. 30, 1998.

The present invention is related to U.S. patent application Ser. Nos. 09/163,893, 09/164,124, 09/164,250, 09/163,808, 09/163,765, 09/163,839, 09/163,954, 09/163,924, 09/163, 904, 09/163,799, 09/163,664, 09/163,518, 09/164,104, 09/163,825, all filed Sep. 30, 1998 Ser. No. 08/128,160, filed Sep. 29, 1993 Ser. No. 08/670,734, Jun. 24, 1996 Ser. No. 08/950,300, Oct. 14, 1997 Ser. No. 08/950,303, Oct. 16, 1997 issued U.S. Pat. No. 5,717,986, U.S. patent application Ser. No. 09/407,332, filed on Sep. 25, 1999, each of the above being incorporated herein by reference.

BACKGROUND

The present invention relates generally to the field of marking devices, and more particularly to a device capable of applying a marking material to a substrate by introducing the marking material into a high-velocity propellant stream.

Ink jet is currently a common printing technology. There are a variety of types of ink jet printing, including thermal ink jet (TIJ), piezo-electric ink jet, etc. In general, liquid ink droplets are ejected from an orifice located at a one terminus of a channel. In a TIJ printer, for example, a droplet is ejected by the explosive formation of a vapor bubble within an ink-bearing channel. The vapor bubble is formed by means of a heater, in the form of a resistor, located on one surface of the channel.

We have identified several disadvantages with TIJ (and other ink jet) systems known in the art. For a 300 spot-per-inch (spi) TIJ system, the exit orifice from which an ink droplet is ejected is typically on the order of about 64 $\mu$m in width, with a channel-to-channel spacing (pitch) of about 84 $\mu$m, and for a 600 dpi system width is about 35 $\mu$m and pitch of about 42 $\mu$m. A limit on the size of the exit orifice is imposed by the viscosity of the fluid ink used by these systems. It is possible to lower the viscosity of the ink by diluting it in increasing amounts of liquid (e.g., water) with an aim to reducing the exit orifice width. However, the increased liquid content of the ink results in increased wicking, paper wrinkle, and slower drying time of the ejected ink droplet, which negatively affects resolution, image quality (e.g., minimum spot size, inter-color mixing, spot shape), etc. The effect of this orifice width limitation is to limit resolution of TIJ printing, for example to well below 900 spi, because spot size is a function of the width of the exit orifice, and resolution is a function of spot size.

Another disadvantage of known ink jet technologies is the difficulty of producing greyscale printing. That is, it is very difficult for an ink jet system to produce varying size spots on a printed substrate. If one lowers the propulsive force (heat in a TIJ system) so as to eject less ink in an attempt to produce a smaller dot, or likewise increases the propulsive force to eject more ink and thereby to produce a larger dot, the trajectory of the ejected droplet is affected. This in turn renders precise dot placement difficult or impossible, and not only makes monochrome greyscale printing problematic, it makes multiple color greyscale ink jet printing impracticable. In addition, preferred greyscale printing is obtained not by varying the dot size, as is the case for TIJ, but by varying the dot density while keeping a constant dot size.

Still another disadvantage of common ink jet systems is rate of marking obtained. Approximately 80% of the time required to print a spot is taken by waiting for the ink jet channel to refill with ink by capillary action. To a certain degree, a more dilute ink flows faster, but raises the problem of wicking, substrate wrinkle, drying time, etc. discussed above.

One problem common to ejection printing systems is that the channels may become clogged. Systems such as TIJ which employ aqueous ink colorants are often sensitive to this problem, and routinely employ non-printing cycles for channel cleaning during operation. This is required since ink typically sits in an ejector waiting to be ejected during operation, and while sitting may begin to dry and lead to clogging.

Other technologies which may be relevant as background to the present invention include electrostatic grids, electrostatic ejection (so-called tone jet), acoustic ink printing, and certain aerosol and atomizing systems such as dye sublimation.

SUMMARY

The present invention is a novel system for delivering marking material to a channel of a device for applying a marking material to a substrate, directly or indirectly, which overcomes the disadvantages referred to above, as well as others discussed further herein. In particular, the present invention relates to a system of the type including a propellant which travels through a channel, and a marking material which is controllably (i.e., modifiable in use) introduced, or metered, into the channel such that energy from the propellant propels the marking material to the substrate. The propellant is usually a dry gas which may continuously flow through the channel while the marking apparatus is in an operative configuration (i.e., in a power-on or similar state ready to mark). The system is referred to as "ballistic aerosol marking" in the sense that marking is achieved by in essence launching a non-colloidal, solid or semi-solid particulate, or alternatively a liquid, marking material at a substrate. The shape of the channel may result in a collimated (or focused) flight of the propellant and marking material onto the substrate.

In our system, the propellant may be introduced at a propellant port into the channel to form a propellant stream. A marking material may then be introduced into the propellant stream from one or more marking material inlet ports. The propellant may enter the channel at a high velocity. Alternatively, the propellant may be introduced into the channel at a high pressure, and the channel may include a constriction (e.g., de Laval or similar converging/diverging type nozzle) for converting the high pressure of the propellant to high velocity. In such a case, the propellant is introduced at a port located at a proximal end of the channel (defined as the converging region), and the marking material ports are provided near the distal end of the channel (at or further down-stream of a region defined as the diverging region), allowing for introduction of marking material into the propellant stream.

In the case where multiple ports are provided, each port may provide for a different color (e.g., cyan, magenta, yellow, and black), pre-marking treatment material (such as a marking material adherent), post-marking treatment material (such as a substrate surface finish material, e.g., matte or gloss coating, etc.), marking material not otherwise visible to the unaided eye (e.g., magnetic particle-bearing material, ultra violet-fluorescent material, etc.) or other marking material to be applied to the substrate. The marking material is imparted with kinetic energy from the propellant stream, and ejected from the channel at an exit orifice located at the distal end of the channel in a direction toward a substrate.

One or more such channels may be provided in a structure which, in one embodiment, is referred to herein as a print head. The width of the exit (or ejection) orifice of a channel is generally on the order of 250 $\mu$m or smaller, preferably in the range of 100 $\mu$m or smaller. Where more than one channel is provided, the pitch, or spacing from edge to edge (or center to center) between adjacent channels may also be on the order of 250 $\mu$m or smaller, preferably in the range of 100 $\mu$m or smaller. Alternatively, the channels may be staggered, allowing reduced edge-to-edge spacing.

The material to be applied to the substrate may be transported to, or metered out of the port into the propellant stream electrostatic control. The structure for accomplishing this electrostatic control comprises a plurality of electrodes arranged in a ladder fashion between a marking material reservoir and channel through which propellant flows and into which the marking material may be introduced. The electrodes are arranged in a phase relationship such that marking material (either particulate or otherwise) may be transported from electrode to electrode by way of electric fields generated by the electrodes.

The material to be applied to the substrate may be a solid or semi-solid particulate material such as a toner or variety of toners in different colors, a suspension of such a marking material in a carrier, a suspension of such a marking material in a carrier with a charge director, a phase change material, etc., both visible and non-visible One preferred embodiment employs a marking material which is particulate, solid or semi-solid, and dry or suspended in a liquid carrier. Such a marking material is referred to herein as a particulate marking material. This is to be distinguished from a liquid marking material, dissolved marking material, atomized marking material, or similar non-particulate material, which is generally referred to herein as a liquid marking material. However, the present invention is able to utilize such a liquid marking material in certain applications, as otherwise described herein. Indeed, the present invention may also be employed in the use of non-marking materials, such as marking pre- and post-treatments, finishes, curing or sealing materials, etc., and accordingly the present disclosure and claims should be read to broadly encompass the transport and marking of wide variety of materials.

Thus, the present invention and its various embodiments provide numerous advantages discussed above, as well as additional advantages which will be described in further detail below.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described, such as pressures, velocities, widths, lengths, etc. These recited ranges are to be treated as examples only, and are not intended to limit the scope of the claims hereof. In addition, a number of materials are identified as suitable for various facets of the embodiments, such as for marking materials, propellants, body structures, etc. These recited materials are also to be treated as exemplary, and are not intended to limit the scope of the claims hereof.

Figure 1:
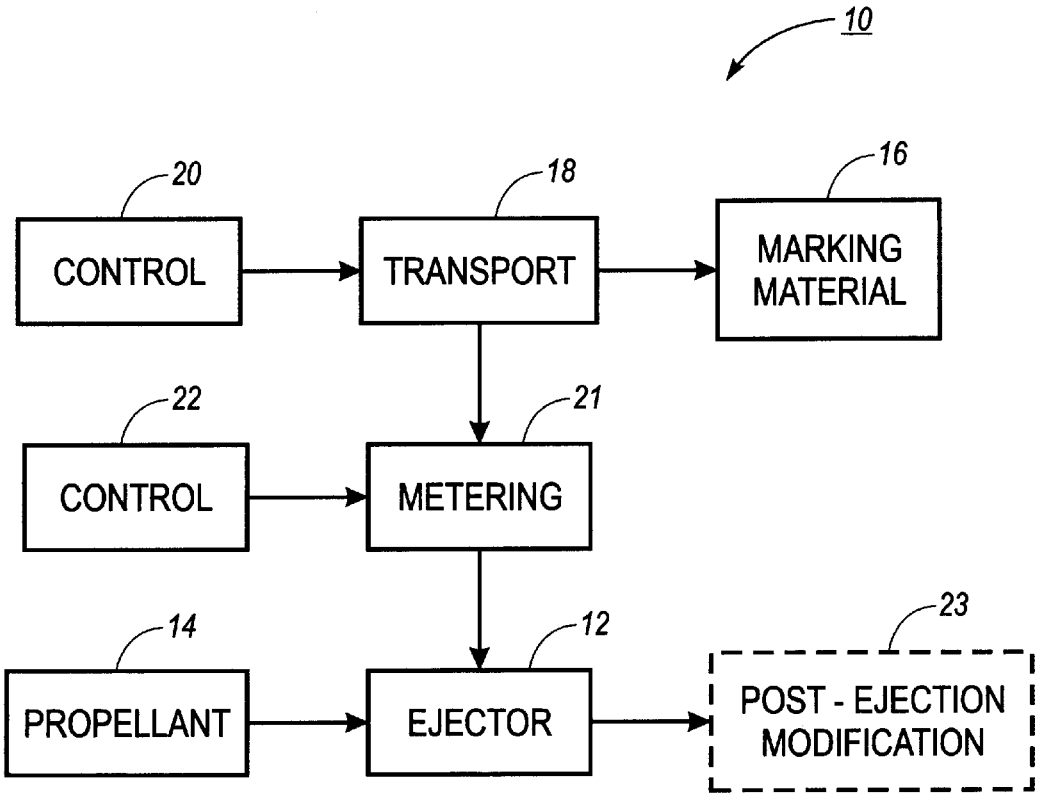
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 consists of one or more ejectors 12 to which a propellant 14 is fed. A marking material 16, which may be transported by a transport 18 under the control of control 20 is introduced into ejector 12. (Optional elements are indicated by dashed lines.) The marking material is metered (that is controllably introduced) into the ejector by metering means 21, under control of control 22. The marking material ejected by ejector 12 may be subject to post ejection modification 23, optionally also part of device 10. It will be appreciated that device 10 may form a part of a printer, for example of the type commonly attached to a computer network, personal computer or the like, part of a facsimile machine, part of a document duplicator, part of a labeling apparatus, or part of any other of a wide variety of marking devices.

Figure 2:
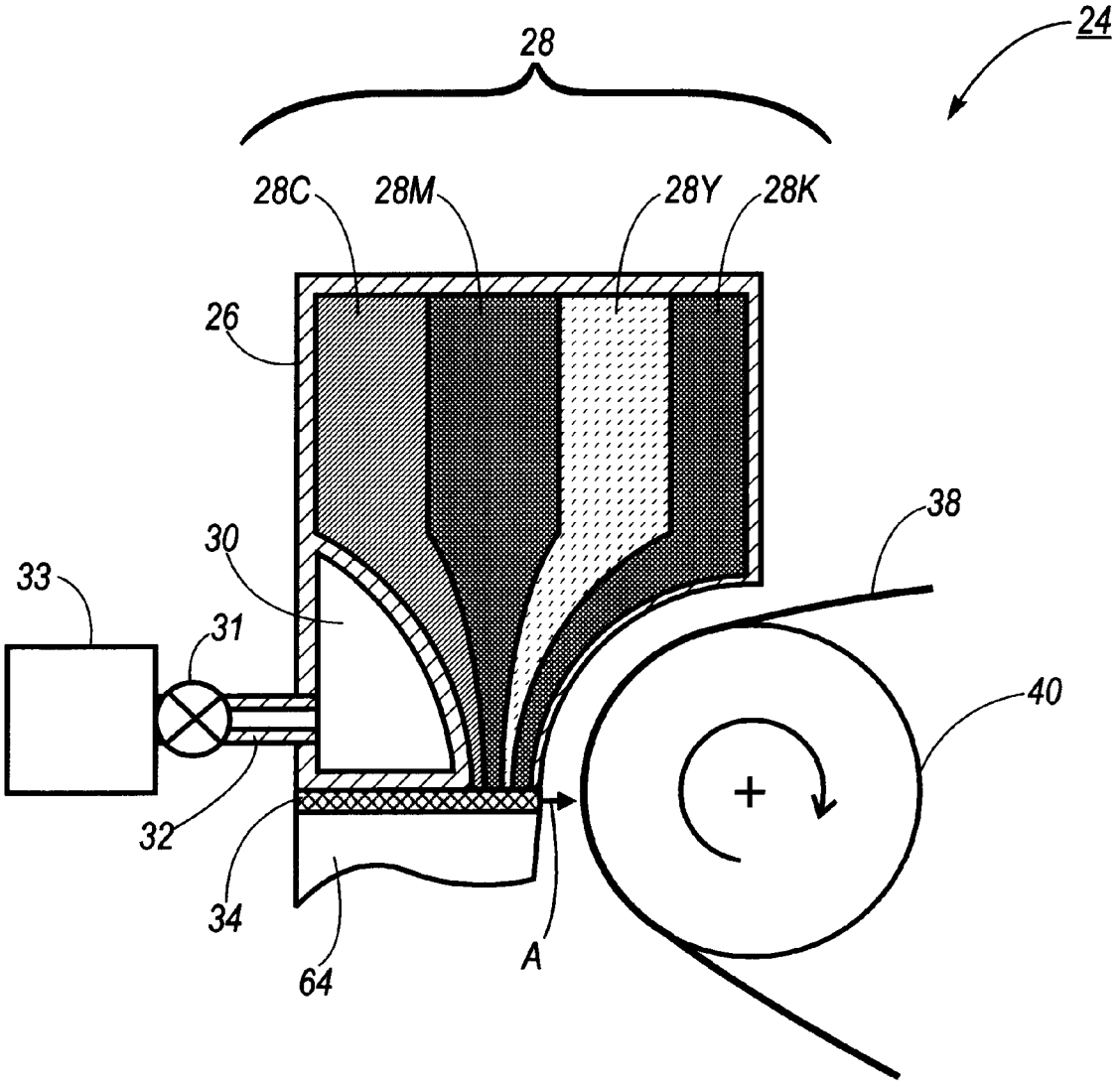
FIG. 2 is cross sectional illustration of a marking apparatus according to one embodiment of the present invention.

The embodiment illustrated in FIG. 1 may be realized by a ballistic aerosol marking device 24 of the type shown in the cut-away side view of FIG. 2. According to this embodiment, the materials to be deposited will be 4 colored toners, for example cyan (C), magenta (M), yellow (Y), and black (K), of a type described further herein, which may be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials such as materials creating a surface for adhering marking material particles (or other substrate surface pre-treatment), a desired substrate finish quality (such as a matte, satin or gloss finish or other substrate surface post-treatment), material not visible to the unaided eye (such as magnetic particles, ultra violet-fluorescent particles, etc.) or other material associated with a marked substrate, is clearly contemplated herein.

Device 24 consists of a body 26 within which is formed a plurality of cavities 28C, 28M, 28Y, and 28K (collectively referred to as cavities 28) for receiving materials to be deposited. Also formed in body 26 may be a propellant cavity 30. A fitting 32 may be provided for connecting propellant cavity 30 to a propellant source 33 such as a compressor, a propellant reservoir, or the like. Body 26 may be connected to a print head 34, comprised of among other layers, substrate 36 and channel layer 37 that will be discussed later.

Figure 3:
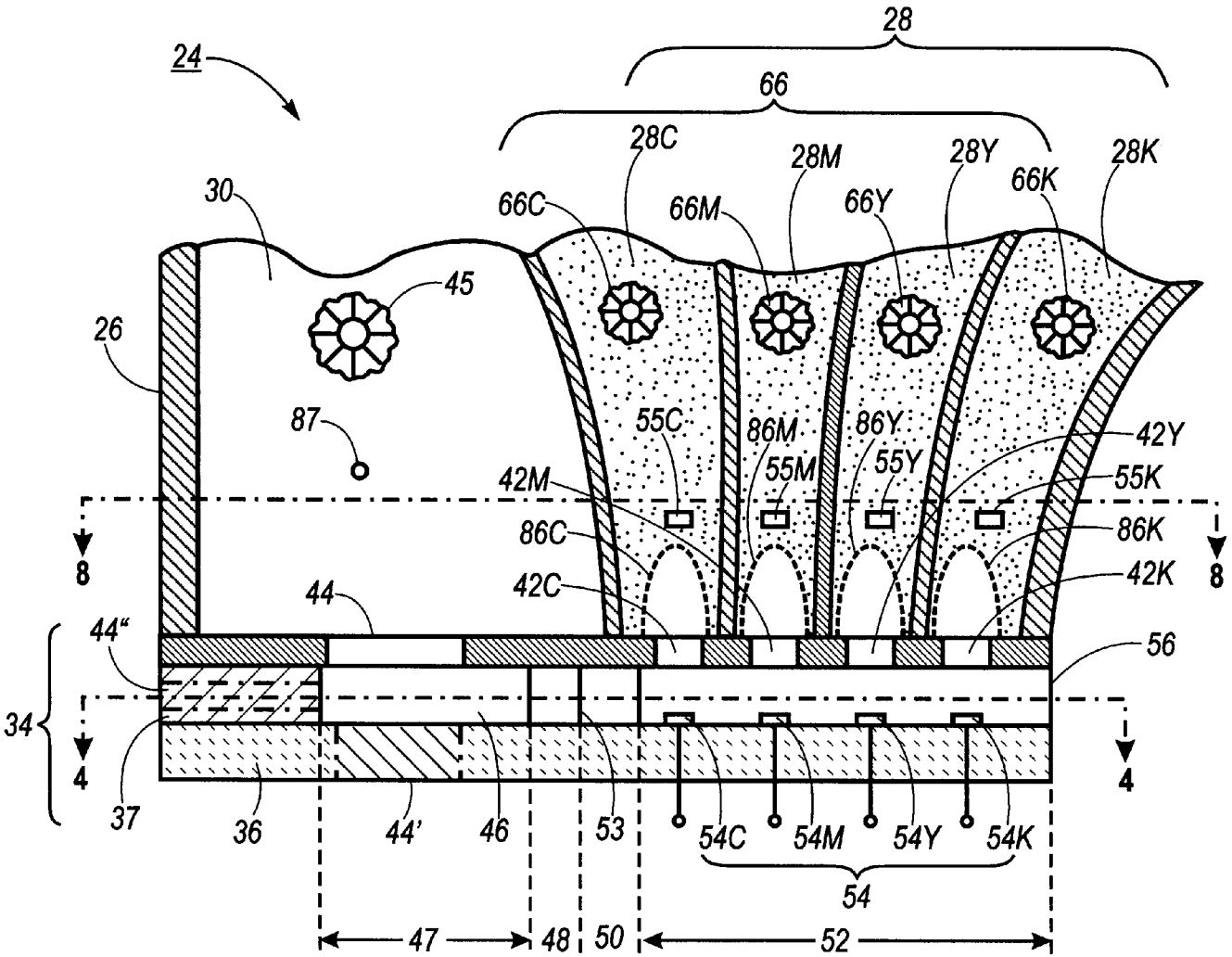
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular or other cross-section, providing communication between said cavities and a channel 46 which adjoins body 26. Ports 42 are shown having a longitudinal axis roughly perpendicular to the longitudinal axis of channel 46. However, the angle between the longitudinal axes of ports 42 and channel 46 may be other than 90 degrees, as appropriate for the particular application of the present invention.

Likewise, propellant cavity 30 includes a port 44, of circular, oval, rectangular or other cross-section, between said cavity and channel 46 through which propellant may travel. Alternatively, print head 34 may be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. We have experimentally demonstrated a propellant marking material flow pattern from a print head employing a number of the features described herein which remains relatively collimated for a distance of up to 10 millimeters, with an optimal printing spacing on the order of between one and several millimeters. For example, the print head produces a marking material stream which does not deviate by more than between 20 percent, and preferably by not more than 10 percent, from the width of the exit orifice for a distance of at least 4 times the exit orifice width. However, the appropriate spacing between the print head and the substrate is a function of many parameters, and does not itself form a part of the present invention.

Referring again to FIG. 3, according to one embodiment of the present invention, print head 34 consists of a substrate 36 and channel layer 37 in which is formed channel 46. Additional layers, such as an insulating layer, capping layer, etc. (not shown) may also form a part of print head 34. Substrate 36 is formed of a suitable material such as glass, ceramic, etc., on which (directly or indirectly) is formed a relatively thick material, such as a thick permanent photoresist (e.g., a liquid photosensitive epoxy such as SU-8, from Microlithography Chemicals, Inc; see also U.S. Pat. No. 4,882,245) and/or a dry film-based photoresist such as the Riston photopolymer resist series, available from DuPont Printed Circuit Materials, Research Triangle Park, N.C. (see, www.dupont.com/pcm/) which may be etched, machined, or otherwise in which may be formed a channel with features described below.

Figure 4:
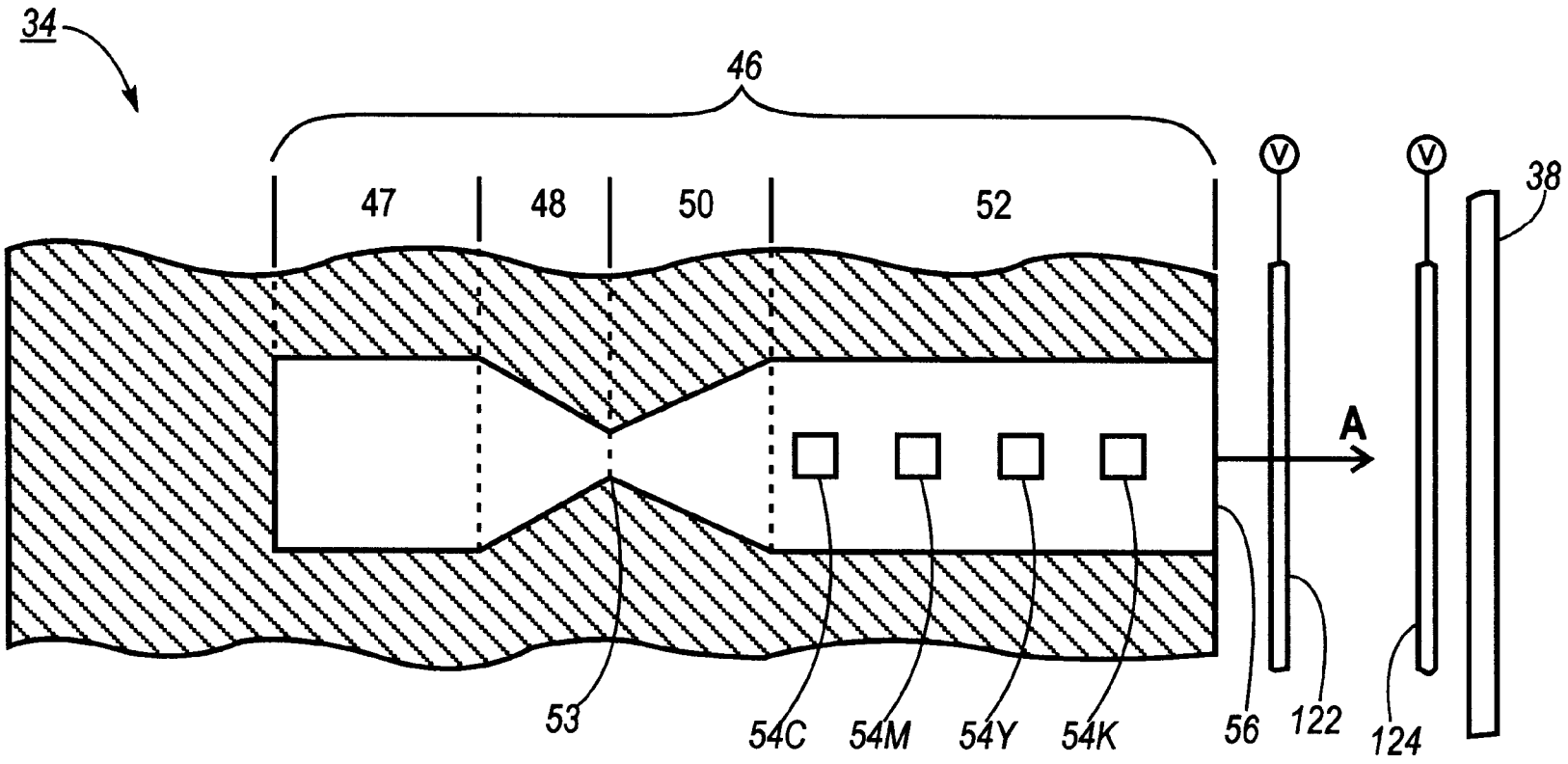
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe. An exit orifice 56 is located at the distal end of channel 46.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant may continuously flow through the channel while the marking apparatus is in an operative configuration (e.g., a "power on" or similar state ready to mark), or may be modulated such that propellant passes through the channel only when marking material is to be ejected, as dictated by the particular application of the present invention. Such propellant modulation may be accomplished by a valve 31 interposed between the propellant source 33 and the channel 46, by modulating the generation of the propellant for example by turning on and off a compressor or selectively initiating a chemical reaction designed to generate propellant, or by other means not shown.

Marking material may controllably enter the channel through one or more ports 42 located in the marking material injection region 52. That is, during use, the amount of marking material introduced into the propellant stream may be controlled from zero to maximum per spot. The propellant and marking material travel from the proximal end to a distal end of channel 46 at which is located exit orifice 56.

Figure 5A:
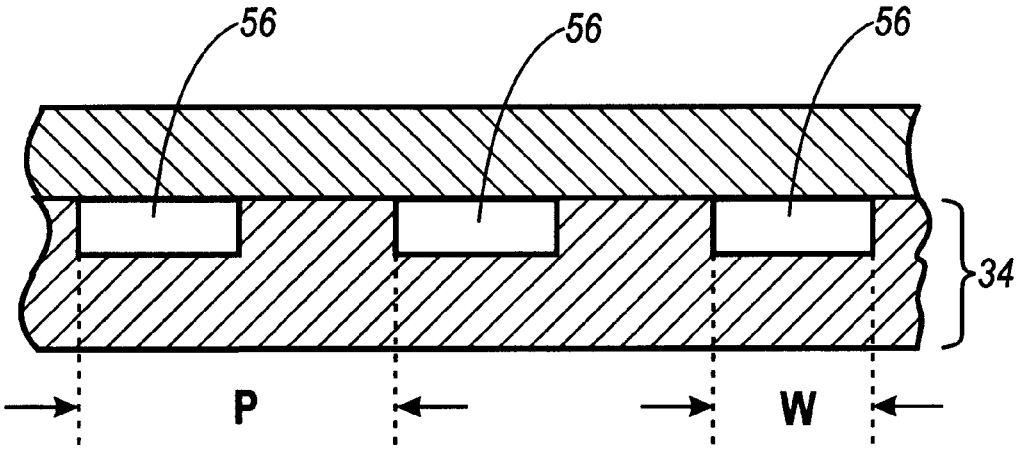
FIGS. 5A and 5B are end views of non-staggered and two-dimensionally staggered arrays of channels according to the present invention.
Figure 5B:
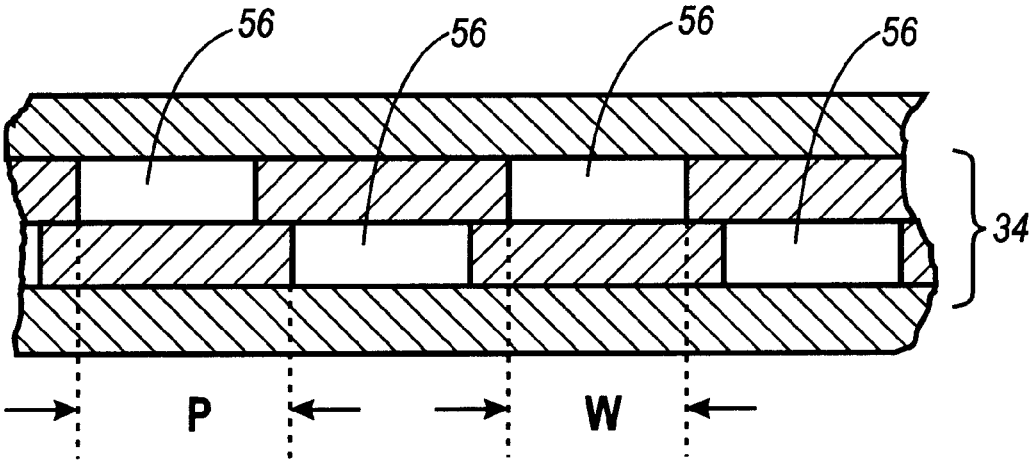

While FIG. 4 illustrates a print head 34 having one channel therein, it will be appreciated that a print head according to the present invention may have an arbitrary number of channels, and range from several hundred micrometers across with one or several channels, to a page-width (e.g., 8.5 or more inches across) with thousands of channels. The width W of each exit orifice 56 may be on the order of 250 $\mu$m or smaller, preferably in the range of 100 $\mu$m or smaller. The pitch P, or spacing from edge to edge (or center to center) between adjacent exit orifices 56 may also be on the order of 250 $\mu$m or smaller, preferably in the range of 100 $\mu$m or smaller in non-staggered array, illustrated in end view in FIG. 5A. In a two-dimensionally staggered array, of the type shown in FIG. 5B, the pitch may be further reduced. For example, Table 1 illustrates typical pitch and width dimensions for different resolutions of a non-staggered array.

TABLE 1

| Resolution | Pitch | Width |
|---|---|---|
| 300 | 84 | 60 |
| 600 | 42 | 30 |

TABLE 1-continued

| Resolution | Pitch | Width |
|---|---|---|
| 900 | 32 | 22 |
| 1200 | 21 | 15 |

Figure 6:
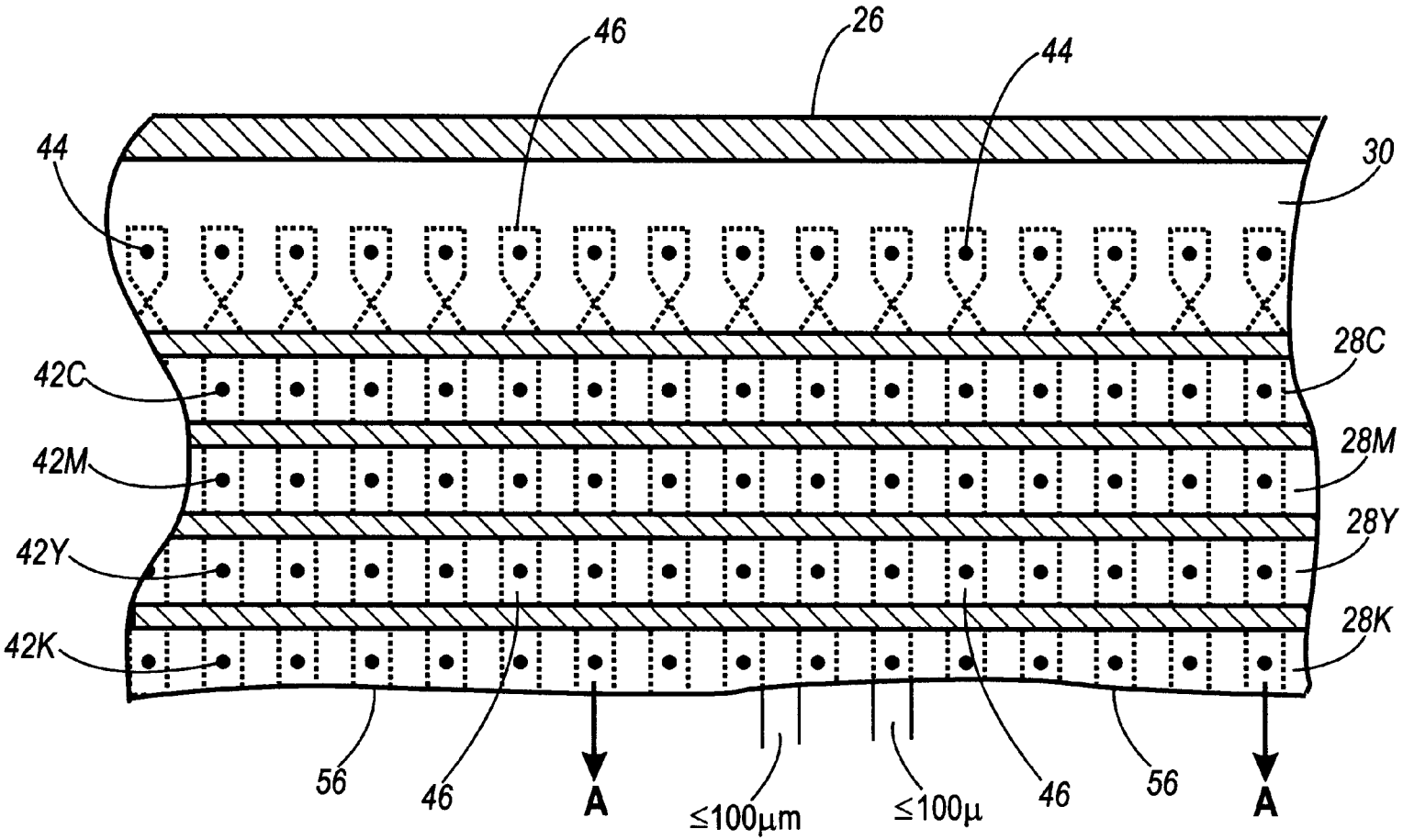
FIG. 6 is a plan view of an array of channels of an apparatus according to one embodiment of the present invention.
Figure 7A:
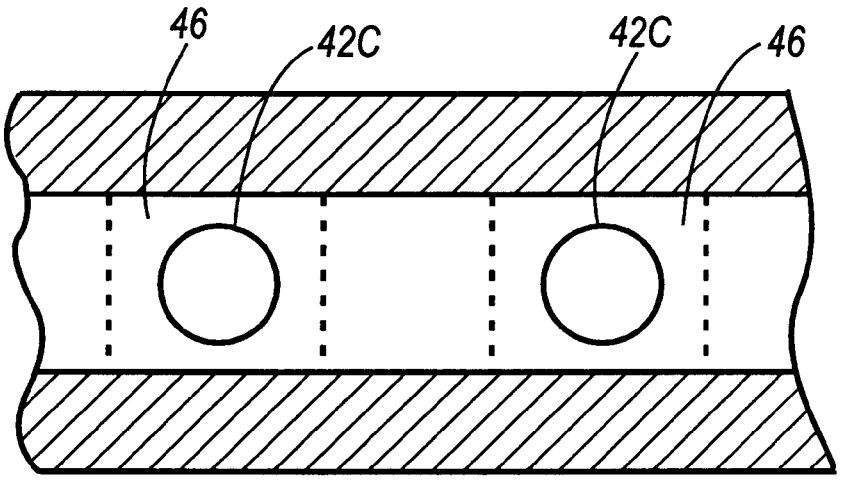
FIGS. 7A and 7B are plan views of a portion of the array of channels shown in FIG. 6, illustrating two embodiments of ports according to the present invention.
Figure 7B:
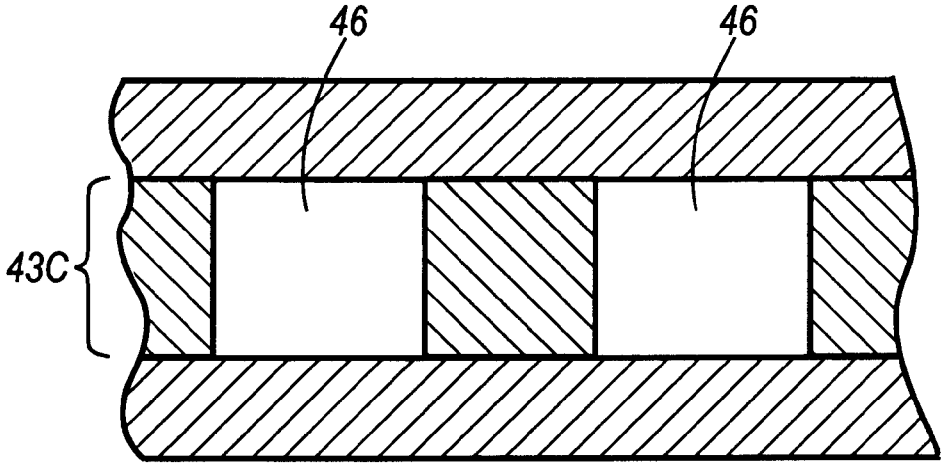

As illustrated in FIG. 6, a wide array of channels in a print head may be provided with marking material by continuous cavities 28, with ports 42 associated with each channel 46. Likewise, a continuous propellant cavity 30 may service each channel 46 through an associated port 44. Ports 42 may be discrete openings in the cavities, as illustrated in FIG. 7A, or may be formed by a continuous opening 43 (illustrated by one such opening 43C) extending across the entire array, as illustrated in FIG. 7B.

Device Operation

Figure 8:
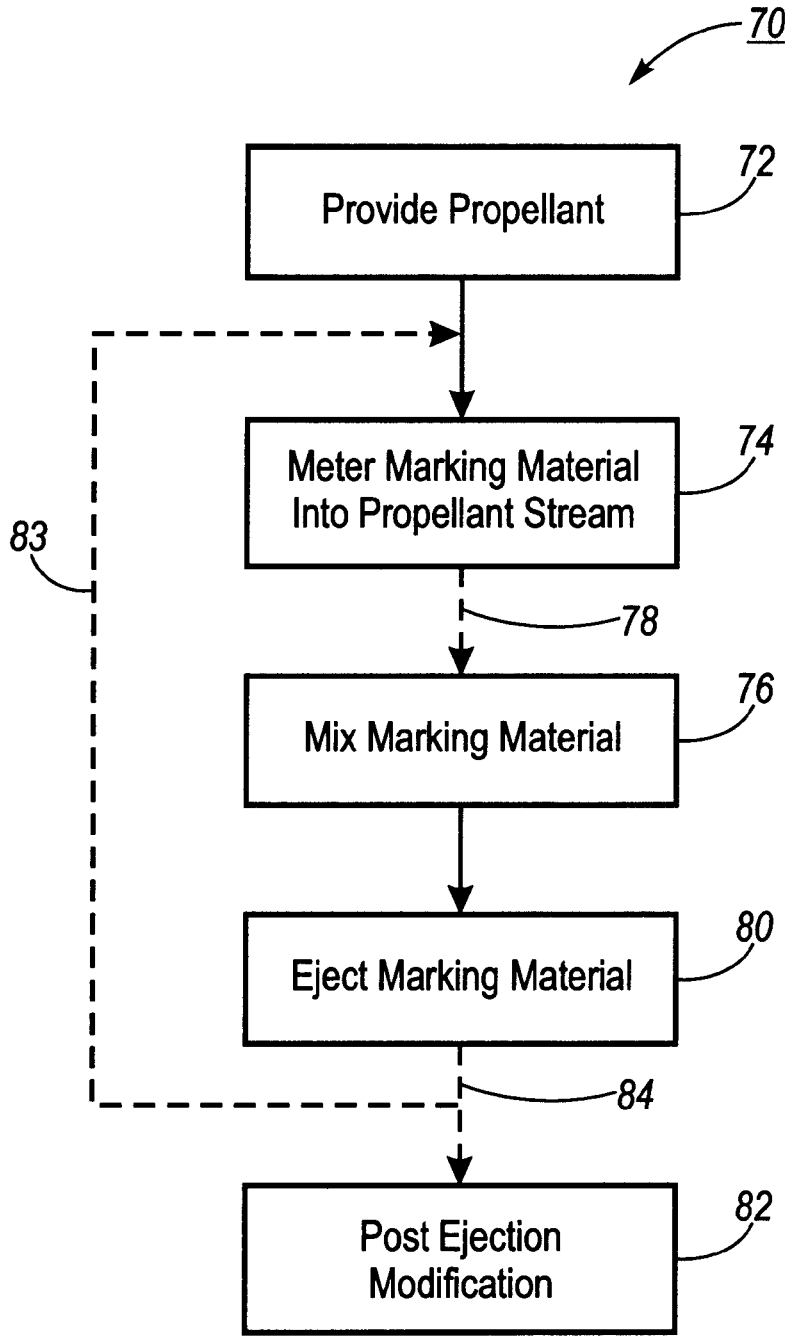
FIG. 8 is a process flow diagram for the marking of a substrate according to the present invention.

The process 70 involved in the marking of a substrate with marking material according to the present invention is illustrated by the steps shown in FIG. 8. According to step 72, a propellant is provided to a channel. A marking material is next metered into the channel at step 74. In the event that the channel is to provide multiple marking materials to the substrate, the marking materials may be mixed in the channel at step 76 so as to provide a marking material mixture to the substrate. By this process, one-pass color marking, without the need for color registration, may be obtained. An alternative for one-pass color marking is the sequential introduction of multiple marking materials while maintaining a constant registration between print head 34 and substrate 38. Since, not every marking will be composed of multiple marking materials, this step is optional as represented by the dashed arrow 78. At step 80, the marking material is ejected from an exit orifice at a distal end of the channel, in a direction toward, and with sufficient energy to reach a substrate. The process may be repeated with reregistering the print head, as indicated by arrow 83. Appropriate post ejection treatment, such as fusing, drying, etc. of the marking material is performed at step 82, again optional as indicated by the dashed arrow 84.

Marking Material

According to one embodiment of the present invention a solid, particulate marking material is employed for marking a substrate. The marking material particles may be on the order of 0.5 to 10.0 $\mu$m, preferably in the range of 1 to 5 $\mu$m, although sizes outside of these ranges may function in specific applications (e.g., larger or smaller ports and channels through which the particles must travel).

There are several advantages provided by the use of solid, particulate marking material. First, clogging of the channel is minimized as compared, for example, to liquid inks. Second, wicking and running of the marking material (or its carrier) upon the substrate, as well as marking material/substrate interaction may be reduced or eliminated. Third, spot position problems encountered with liquid marking material caused by surface tension effects at the exit orifice are eliminated. Fourth, channels blocked by gas bubbles retained by surface tension are eliminated. Fifth, multiple marking materials (e.g., multiple colored toners) can be mixed upon introduction into a channel for single pass multiple material (e.g., multiple color) marking, without the risk of contaminating the channel for subsequent markings (e.g., pixels). Registration overhead (equipment, time, related print artifacts, etc.) is thereby eliminated. Sixth, the channel refill portion of the duty cycle (up to 80% of a TIJ duty cycle) is eliminated. Seventh, there is no need to limit the substrate throughput rate based on the need to allow a liquid marking material to dry.

However, despite any advantage of a dry, particulate marking material, there may be some applications where the use of a liquid marking material, or a combination of liquid and dry marking materials, may be beneficial. In such instances, the present invention may be employed, with simply a substitution of the liquid marking material for the solid marking material and appropriate process and device changes apparent to one skilled in the art or described herein, for example substitution of metering devices, etc.

In certain applications of the present invention, it may be desirable to apply a substrate surface pre-marking treatment. For example, in order to assist with the fusing of particulate marking material in the desired spot locations, it may be beneficial to first coat the substrate surface with an adherent layer tailored to retain the particulate marking material. Examples of such material include clear and/or colorless polymeric materials such as homopolymers, random copolymers or block copolymers that are applied to the substrate as a polymeric solution where the polymer is dissolved in a low boiling point solvent. The adherent layer is applied to the substrate ranging from 1 to 10 microns in thickness or preferably from about 5 to 10 microns thick. Examples of such materials are polyester resins either linear or branched, poly(styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates and mixtures thereof and the like. This surface pre-treatment may be applied from channels of the type described herein located at the leading edge of a print head, and may thereby apply both the pre-treatment and the marking material in a single pass. Alternatively, the entire substrate may be coated with the pre-treatment material, then marked as otherwise described herein. See U.S. patent application Ser. No. 08/041,353, incorporated herein by reference. Furthermore, in certain applications it may be desirable to apply marking material and pre-treatment material simultaneously, such as by mixing the materials in flight, as described further herein.

Likewise, in certain applications of the present invention, it may be desirable to apply a substrate surface post-marking treatment. For example, it may be desirable to provide some or all of the marked substrate with a gloss finish. In one example, a substrate is provided with marking comprising both text and illustration, as otherwise described herein, and it is desired to selectively apply a gloss finish to the illustration region of the marked substrate, but not the text region. This may be accomplished by applying the post-marking treatment from channels at the trailing edge of the print head, to thereby allow for one-pass marking and post-marking treatment. Alternatively, the entire substrate may be marked as appropriate, then passed through a marking device according to the present invention for applying the post-marking treatment. Furthermore, in certain applications it may be desirable to apply marking material and post-treatment material simultaneously, such as by mixing the materials in flight, as described further herein. Examples of materials for obtaining a desired surface finish include polyester resins either linear or branched, poly (styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates, and mixtures thereof and the like.

Other pre- and post-marking treatments include the underwriting/overwriting of markings with marking material not visible to the unaided eye, document tamper protection coatings, security encoding, for example with wavelength specific dyes or pigments that can only be detected at a specific wavelength (e.g., in the infrared or ultraviolet range) by a special decoder, and the like. See U.S. Pat. Nos. 5,208,630, 5,385,803, and 5,554,480, each incorporated herein by reference. Still other pre- and post-marking treatments include substrate or surface texture coatings (e.g. to create embossing effects, to simulate an arbitrarily rough or smooth substrate), materials designed to have a physical or chemical reaction at the substrate (e.g., two materials which, when combined at the substrate, cure or otherwise cause a reaction to affix the marking material to the substrate), etc. It should be noted, however, that references herein to apparatus and methods for transporting, metering, containing, etc. marking material should be equally applicable to pre- and post-marking treatment material (and in general, to other non-marking material) unless otherwise noted or as may be apparent to one skilled in the art.

Metering (and Transport) of Marking Material

A critical step in the marking process is metering the marking material into the propellant stream. Transport of the marking material is also important, and the following discussion, while focussing on metering, necessarily also applies to transport. While the following specifically discusses the metering of marking material, it will be appreciated that the metering of other material such as the aforementioned pre- and post-marking treatment materials is also contemplated by this discussion, and references following which exclusively discuss marking material do so for simplicity of discussion only. Metering, then, may be accomplished by one of a variety of embodiments of the present invention.

According to a first embodiment for metering the marking material, the marking material includes material which may be imparted with an electrostatic charge. For example, the marking material may be comprised of a pigment suspended in a binder together with charge capture or control additives. The charge capture additives may be charged, for example by way of a corona 66C, 66M, 66Y, and 66K (collectively referred to as coronas 66), located in cavities 28, shown in FIG. 3. Another alternative is to initially charge the propellant gas, e.g., by way of a corona 45 in cavity 30 (or some other appropriate location such as port 44, etc.) The charged propellant may be made to enter into cavities 28 through ports 42, for the dual purposes of creating a fluidized bed 86C, 86M, 86Y, and 86K (collectively referred to as fluidized bed 86, and discussed further below), and imparting a charge to the marking material. Other alternatives include tribocharging, by other means external to cavities 28, or other mechanism.

Figure 9A:
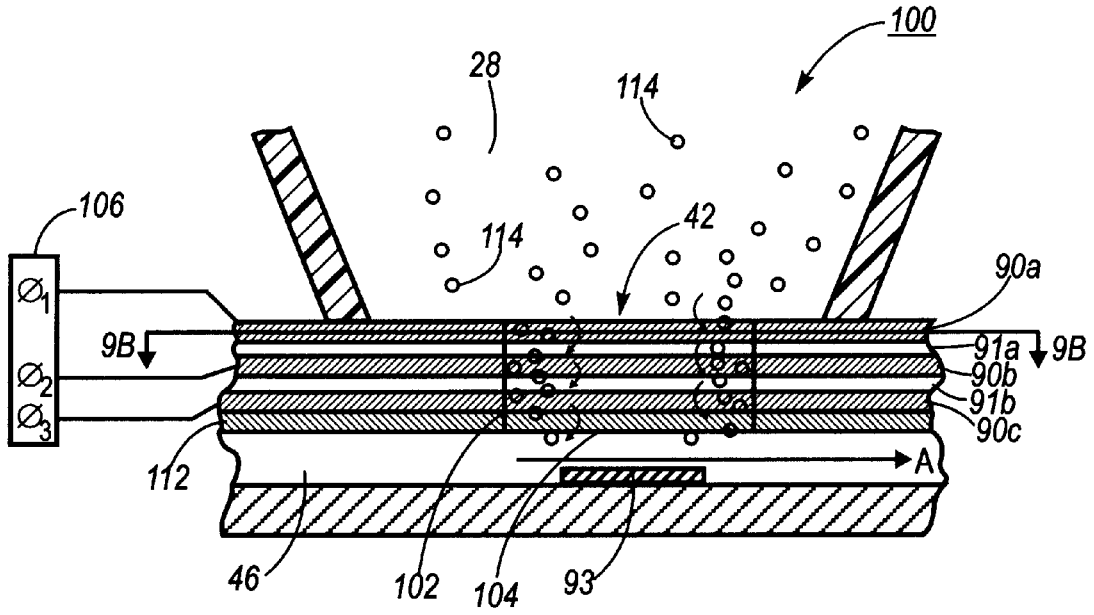
FIG. 9A is cross-sectional side view.
Figure 9B:
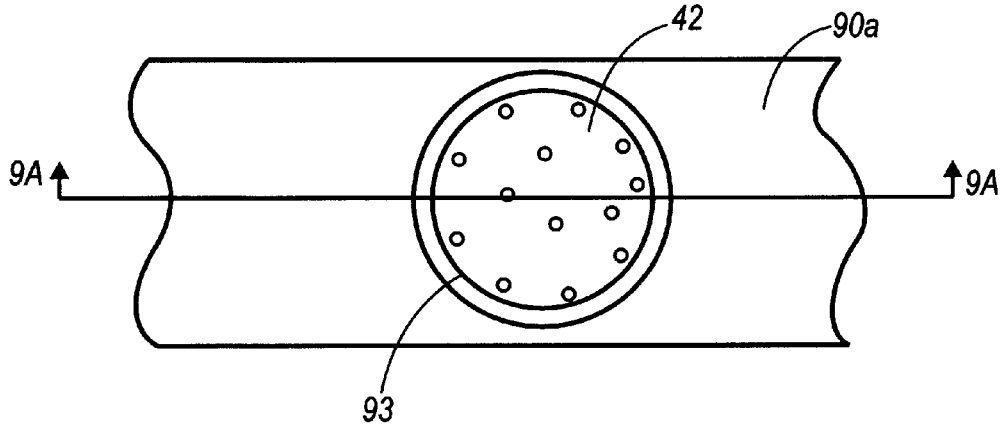
FIG. 9B is a top view, of a marking material metering device according to one embodiment of the present invention, employing an electrode structure.

With reference now to FIGS. 9A and 9B, there is illustrated therein one embodiment of the present invention. The marking material transport and metering structure 100 shown in a cut-away side view in FIG. 9A comprises a stacked electrode structure 102 which includes a minimum of three electrodes. Electrode structure 102 is disposed between cavity 28 containing marking material particles 24 (however, cavity 28 may contain material other than a marking material, although cavity 28 is generically referred to in this description as a marking material reservoir, for simplicity and clarity of explanation). Electrode structure 102 terminates at an injection port 104 in channel 46, for example in the diverging region 52. Connected to electrode structure 102 is driving circuitry 106, also illustrated and described further below. FIG. 9B shows this structure in plan view.

The particulate marking material employed by the present invention may or may not be charged, depending on the desired application. In the event that a charged particulate marking material is employed, the charge on the marking material may be imparted by way of a corona 66.

In operation, a traveling electrostatic wave is established by driving circuitry 106 across electrode structure 102 in a direction from cavity 28 toward injection port 104. Marking material particles in the cavity 28 which are positioned proximate the electrode structure 102, for example by gravity feed, are transported by the traveling electrostatic wave in the direction of injection port 104. Once the marking material particles reach the injection port 104, they are introduced into a propellant stream (not shown) and carried thereby in the direction of arrow A toward a substrate (not shown)

Figure 10:
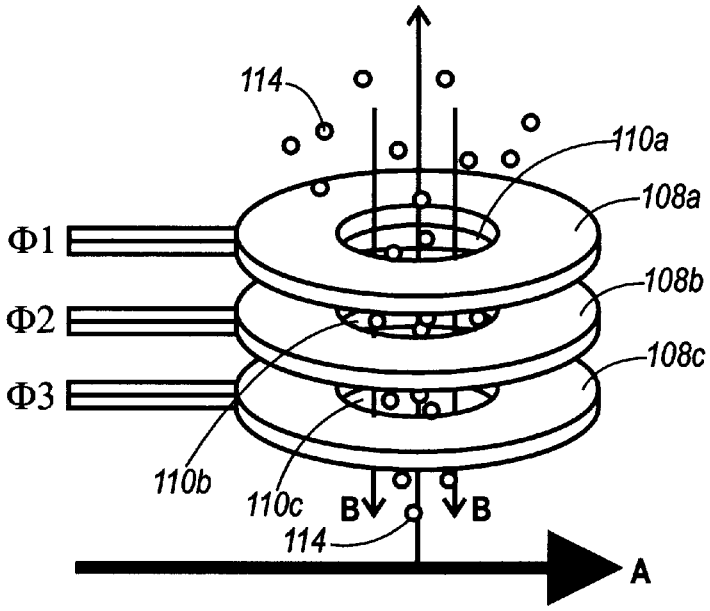
FIG. 10 is a perspective view of an electrode structure of a type employed in the device of FIGS. 9A and 9B.

FIG. 10 is a perspective illustration of a portion of an electrode structure 102 according to one embodiment of the present invention. Electrode structure 102 consists of a plurality of electrodes 108*a,* 108*b,* 108*c,* each defining an annular opening 110*a,* 110*b,* 110*c,* respectively. These electrodes are grouped into sets, each set containing at least three such electrodes (although a greater number of electrodes per set is clearly contemplated by this description). Each electrode 108*a,* 108*b,* 108*c* is connected to a driver circuit, such as an inverting amplifier or other driver circuit, as appropriate (not shown). Each driver is connected to clock generator and logic circuitry (not shown). More details on the driver and clock circuitry are provided in applicant's incorporated U.S. patent application Ser. No. 09/163,839.

Referring again to FIG. 9A, shown therein is a cross section of a device 100. In one embodiment, electrodes 108*a,* 108*b,* 108*c* are formed in layers 90*a,* 90*b,* 90*c,* respectively, on top of insulating substrate 112, with insulating layers 91*a* and 91*b* formed therebetween. Alternatively, electrodes 90*a,* 90*b,* and 90*c* may be photolithographically patterned, with appropriate insulation therebetween, and electrical interconnection as further discussed below.

In operation, control signals from the clock generator and logic circuitry are applied to the electrode drivers which sequentially provide a phased voltage for example, 25–250 volts preferably in the range of 125 volts, to the electrodes 108*a,* 108*b,* 108*c* to which they are connected. It will be noted that in order to establish a sufficient traveling wave at least three groups of electrodes are required, meaning that a voltage source of at least three phase is required. However, a greater number of groups and a great number of voltage phases may be employed as determined by the desired application of the present invention.

A typical operating frequency for the voltage source is between a few hundred Hertz and 5 kHz depending on the charge and the type of marking material in use. The traveling wave may be d.c. phase or a.c. phase, with d.c. phase preferred.

The force F required to move a marking material particle from one electrode to an adjacent electrode is given by $F=Q.E_t$, where Q is the charge on the marking material particle, and $E_t$ is the tangential field established by the electrodes, given by $E_t=[1/d][V_{\phi 1}(t)-V_{\phi 2}(t)]$. In the later equation, d is the spacing between electrodes, and $V_{\phi 1}(t)$ and $V_{\phi 2}(t)$ are the voltages of the two adjacent electrodes, typically varying as a function of time. For peak a.c. voltage $v_p$ from a sinusoidal waveform of the type shown in FIG. 4 (three-phase), the resulting field $E_t$ is given by $E_t(v_p)=[1/d][v_p\sin(\omega_t)+v_p\sin(\omega_t+\phi)]$, where $\phi$ is the phase difference between the two voltage waveforms. The maximum field thus depends on the phase of the waveform. The largest filed is obtained when the phase difference between the two waveforms is 180 degrees. In this case, the field equation reduces to $E_t=2v_p/d$.

However, a sinusoidal system can never achieve this maximum value since with a 180 degree phase shift in the waveform, the traveling wave looses directionality. Thus, the phase shift must always be something less (or more) than 180 degrees.

However, a phased d.c. waveform is able to achieve the $E_t=2v_p/d$ maximum field without loosing directionality of the traveling wave. The maximum $E_t=2v_p/d$ is obtained during the time that all but one of the waveforms have a zero voltage. At this time, the waveforms have sufficient overlap to impart directionality to the traveling wave established by the electrodes.

In either the case of an a.c. or d.c. waveform, a traveling wave is established along the electrode structure 102 in the direction of arrows B of FIG. 10. Particles 114 of marking material travel from electrode to electrode, for example due to their attraction to an oppositely charge electrode.

Fabrication of electrodes 36 and required interconnections may be done in conjunction with the fabrication of associated circuitry such as drivers and clock and logic circuitry. Alternatively, the control circuitry may be off-board.

A coating layer may overlay the electrode structure for physical protection, electrical isolation, and other functions discussed in the aforementioned and incorporated U.S. patent applications Ser. Nos. 09/163,518, 09/163,664, and 09/163,825.

Figure 11:
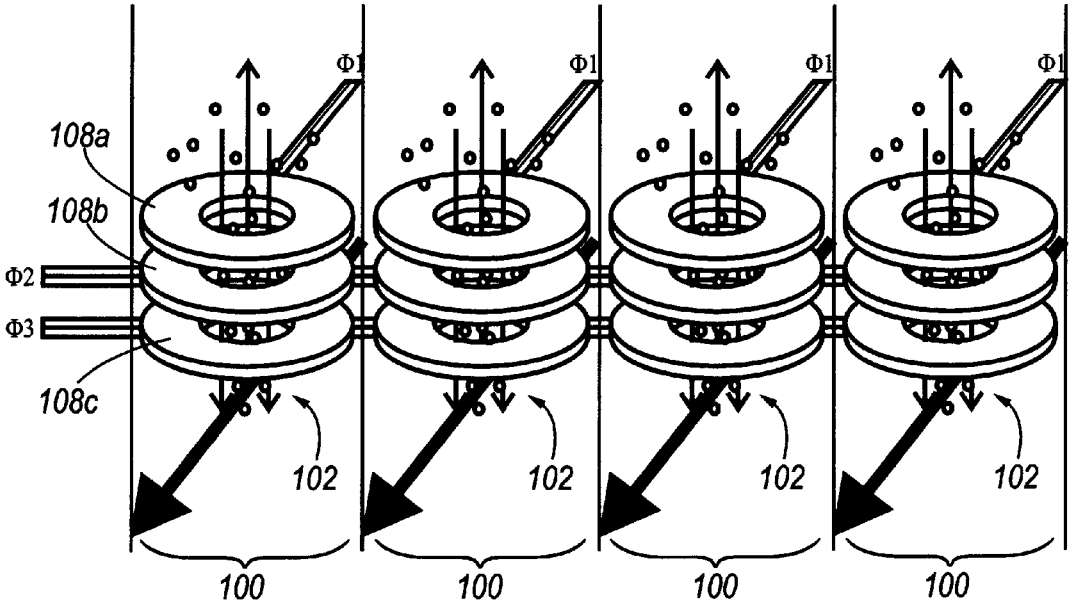
FIG. 11 is a perspective view of an array of electrode structures.

Ideally, electrode structure 102 will be one of an array of such structures in a complete marking device. An example of such an array is illustrated in FIG. 11. One problem posed by such an array is the number of interconnections required to individually address each electrode. We have devised a scheme to simplify this interconnection. FIG. 11 illustrates a matrix array technique which dramatically reduces the number of interconnections to an array of electrodes. Each material transport and metering structure 100 includes an associate electrode structure 102 comprised of at least three electrodes 108*a,* 108*b,* and 108*c* (referred to as a set of electrodes). The electrodes 108*b* of each set is electrically connected to the electrodes 108*b* of each of the other sets in the array. Likewise, the electrodes 108*c* of each set is electrically connected to each electrode 108*c* of each of the other sets in the array. Each of the electrodes 108*a* of each set is separately addressed. Thus, if n is the number of material transport and metering structures 100 in the marking device, then the total connections required may be as small as n+2. This should be compared to the number 3n which would be required to individually address each electrode. In operation, the electrodes 108*b* and 108*c* are operated collectively in a phase relationship, and metering of marking material into a desired channel is accomplished by selectively activating electrode 108*a* corresponding to the desired channel.

In a preferred embodiment, each material transport and metering structures 100 will consist of multiple sets stacked end-to-end, with the various electrodes interconnected as described above (i.e., all electrodes 108*b* electrically connected together, all electrodes 108*c* electrically connected, and all electrodes 108*a* from each material transport and metering structure 100 electrically connected, but electrically isolated from the electrodes 108*a* of other material transport and metering structures 100). In so doing, it is desirable to provide a region through which the marking material may travel, preferably a concentrically aligned annular region 110*a,* 110*b,* 110*c,* as illustrated in FIG. 10.

Figure 12:
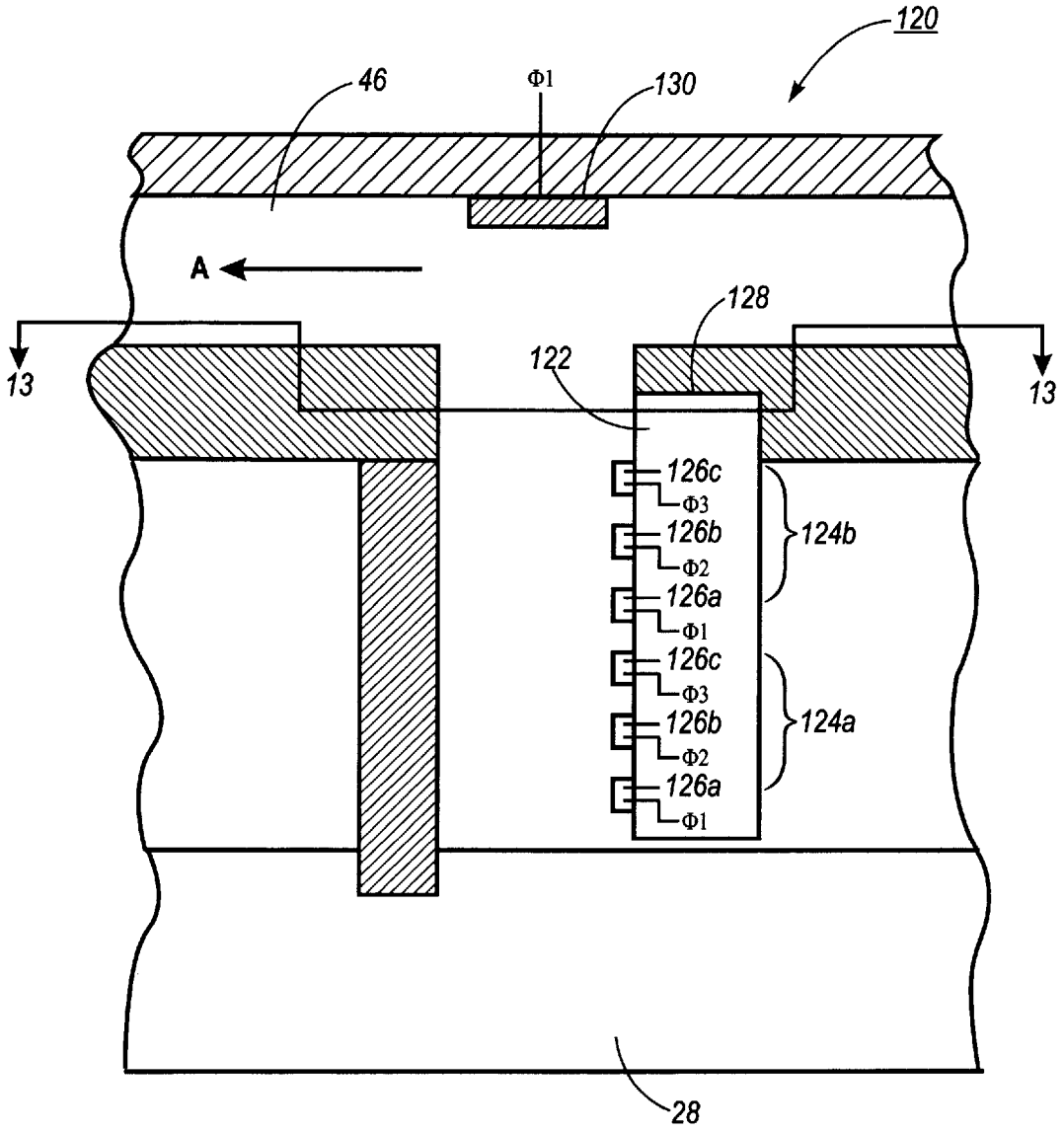
FIG. 12 is an alternate embodiment of an electrode structure according to the present invention.
Figure 13:
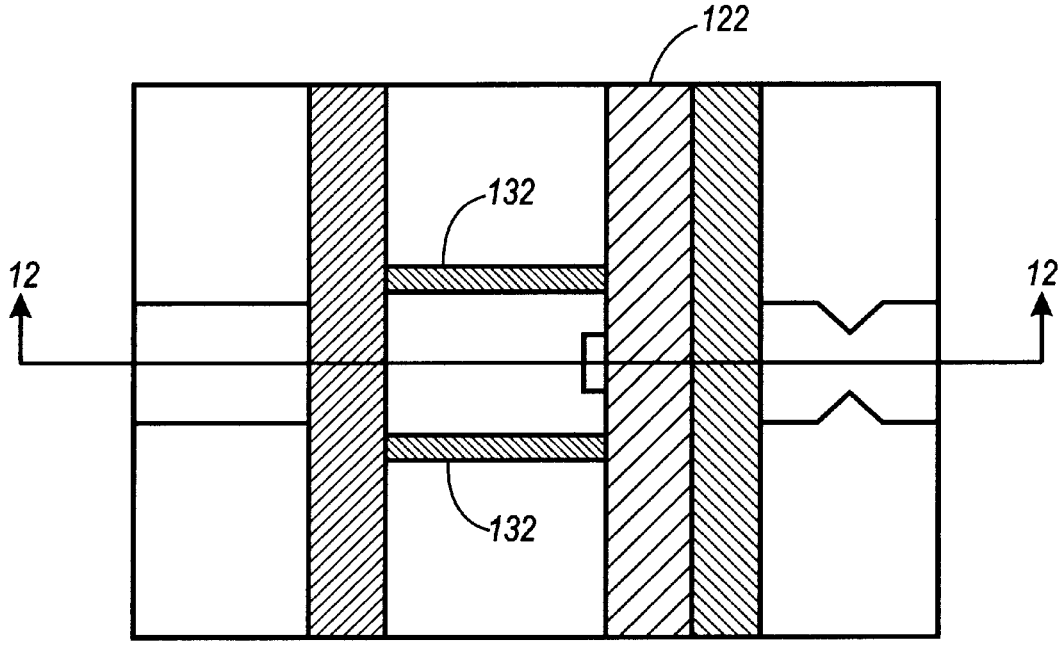
FIG. 13 is a plan view of the embodiment of an electrode structure of FIG. 12.

An alternate embodiment 120 of a material transport and metering structure is shown in FIG. 12. According to this embodiment, a planar structure 122 is provided between cavity 28 and channel 46. Sets 124*a,* 124*b* of at least three stacked electrodes 126*a,* 126*b,* 126*c* are provided on a surface of planar structure 122. These may be formed photolithographically by process well known in the art, and may be connected to driver and clock circuitry as described for example in applicant's incorporated U.S. patent application Ser. No. 09/163,839. The thickness of the electrodes 126*a,* 126*b,* 126*c,* and insulation (not shown) required to electrically insulate the electrodes may be on the order of 5 $\mu$m to 15 $\mu$m depending on the size of the marking material particles (e.g. 3 $\mu$m, 5 $\mu$m, etc.). Planar structure 122 may be located with the assembly of the marking device for example by way of an alignment key 128 (for example on the order of 100 microns or more) or by other technique known in the art. An auxiliary electrode 130 may be positioned inside the channel 46, and operated in phase with an electrode of the sets 124, such as with electrode 126*a,* to assist in "pulling" marking material into the channel 46. Individual columns of electrodes which may, for example, supply marking material to a single channel, may be isolated from one another by means of lateral barriers 132 as illustrated in FIG. 13. Lateral barriers 132 may be formed of this photoresist and defined by well known photolithographic techniques.

Again, the driving and clock circuitry may be on-or off-chip to provide phased input waveforms in a number equal to the number of electrodes per set (three-phase for three electrodes per set, four-phase for four electrodes per set, and so on). Drivers may switch from ground to a high (e.g. 75 volts) to generate the electrostatic field that moves the toner from electrode to electrode. The operating voltage for the drivers may be in the range of 15 volts to 125 volts depending on the electrode line width and electrode-to-electrode spacing. Typically, a field strength of 5–6 volts/$\mu$m should be maintained for desirable marking material motion. Incorporated U.S. patent application Ser. No. 09/163,839 describes further details about driving and clock circuitry.

It will now be appreciated that various embodiments of a particulate marking material transport device have been disclosed herein. The embodiments described and alluded to herein are capable of transporting marking material both intentionally charged and uncharged. Driving electronics may be integrally formed with an array of interdigitated electrodes. A plurality of such transports may be used in conjunction to provide multiple colors of marking material to a full color printer, to transport marking material not otherwise visible to the unaided eye (e.g., magnetic marking material), surface finish or texture material, etc. Thus, it should be appreciated that the description herein is merely illustrative, and should not be read to limit the scope of the invention nor the claims hereof.

What is claimed is:

1. A structure for use in an apparatus for ejecting a marking material, comprising;

a body having at least two adjacent channels therein;

a marking material reservoir communicatively connected to at least one of said two adjacent channels; and a metering device comprising a marking material transport region interposed between and communicatively coupled to at least one of said channels and said marking material reservoir, the marking material transport region including at least three electrodes, the at least three electrodes to generate an electric field to move portions of said marking material from said reservoir into said at least one channel.

2. The structure of claim 1, further comprising a plurality of insulating layers, each of said insulating layers being disposed between and in contact with two of said at least three electrodes, such that each of said at least three electrodes are electrically insulated from one another.

3. The structure of claim 1, wherein each of said electrodes has a generally annular planform around a central axis to thereby define a central region, and further wherein said electrodes are generally coaxial so that the central regions thereof define said material transport region.

4. The structure of claim 1, wherein each channel of said two adjacent channels has associated therewith a metering device.

5. The structure of claim 4 wherein said metering device includes a corresponding set of electrodes, each set comprising in order a first, a second, and a third electrode, the first electrode of each set in electrical communication with the first electrode of each of the other said sets, the second electrode of each set in electrical communication with the second electrode of each of the other said sets, and the third electrode of each set electrically insulated from the third electrode of each of the other said sets, such that each of said third electrodes are independently controllable.

6. The structure of claim 5, wherein the first electrode is located roughly in a first plane, the second electrode is located roughly in a second plane parallel to the first plane, and the third electrode is located roughly in a third plane parallel to the first and second planes.

7. The structure of claim 6, wherein each metering device comprises a plurality of corresponding sets of electrodes, each set coaxially arranged, and further wherein each said first electrode of each said set is in electrical communication with each other first electrode of said set, each said second electrode of each said set is in electrical communication with each other second electrode of said set, and each said third electrode of each said set is in electrical communication with each other third electrode of said set.

8. The structure of claim 1 wherein the marking material is a dry particulate making material.

9. The structure of claim 8 wherein the dry particulate marking material is electrically charged.

10. The structure of claim 1 further comprising:

a three phase voltage source coupled to the three electrodes.

11. The structure of claim 10 wherein the three phase voltage source is set to establish a traveling wave through the marking material.

12. A structure for transporting a marking material, comprising;

a substrate having a proximal end and a distal end;

a marking material reservoir communicatively connected with said proximal end;

a channel communicatively connected with said distal end;

at least three electrodes formed on said substrate, a first of said electrodes being located generally at the proximal end of said substrate such that an electric field generated by said first electrode extends at least part-way into said marking material reservoir and further such that marking material located in said marking material reservoir may be attracted to said first electrode, each of said other at least three electrodes being configured such that each may selectively generate an electric field to thereby transport marking material from one electrode to another in a direction from said marking material reservoir toward said channel.

13. The structure of claim 12, further comprising lateral barriers, each lateral barrier having one edge in contact with said substrate, a marking material transport region being thereby defined between adjacent pairs of lateral barriers.

14. A marking material delivery structure, comprising:

a marking material reservoir;

a body having defined therein a channel and a port such that marking material may be introduced through said port into said channel;

a substrate extending between said marking material reservoir and said body;

a plurality of sets of electrodes, each set comprising in order a first, a second, and a third electrode, the sets of electrodes arranged on the substrate such that, for each adjacent set of electrodes, the third electrode from one set is adjacent the first electrode of an adjacent set, and further such that a first set of electrodes is adjacent the marking material reservoir such that a first electrode of the first set of electrodes to generate an electric field that extends at least part-way into said marking material reservoir, and still further such that a final set of electrodes is adjacent the body such that a third electrode of the final set of electrodes to generate an electric field that extends at least part-way into said channel;

whereby said plurality of sets of electrodes are selectively activatable to thereby selectively generate electric fields which transport marking material from the marking material reservoir through said port and into said channel.

15. The structure of claim 14, wherein said first electrode of each said set of electrodes is in electrical communication with each first electrode of each of the other of said plurality of sets of electrodes, and further wherein said second electrode of each said set of electrodes is in electrical communication with each second electrode of each of the other of said plurality of sets of electrodes.

16. The structure of claim 14, further comprising lateral barriers, each lateral barrier having one edge in contact with said substrate, a marking material transport region being thereby defined between adjacent pairs of lateral barriers, and still further wherein each marking material transport region has disposed therein a plurality of electrode sets.

17. The structure of claim 14, wherein said first electrode of each said set of electrodes is in electrical communication with each first electrode of each of the other of said plurality of sets of electrodes, and further wherein said second electrode of each said set of electrodes is in electrical communication with each second electrode of each of the other of said plurality of sets of electrodes, and still further wherein said third electrode of each set of electrodes disposed within a first marking material transport region is in electrical communication with each third electrode of each of the other of said plurality of sets of electrodes disposed within said first marking material transport region but electrically isolated from the electrodes of those sets of electrodes disposed outside said first marking material transport region.

18. A marking material delivery structure, comprising:

a marking material reservoir, a body having defined therein a plurality of channels, each channel having a port associated therewith such that marking material may be introduced through said port into said channel;

a substrate extending between said marking material reservoir and said body;

a plurality of marking material delivery regions, each region bounded by an opposing pair of lateral barriers, an opposing barrier, and said substrate;

each marking material delivery region having disposed therein sets of electrodes, each set comprising in order an initial electrode, at least one intermediate electrode, and a terminal electrode, the sets of electrodes arranged on the substrate such that, for each adjacent set of electrodes within a marking material delivery region, the terminal electrode from one set is adjacent the initial electrode of an adjacent set, and further such that a first set of electrodes in each marking material delivery region is adjacent the marking material reservoir such that an initial electrode of a first set of to generate an electric field that extends at least part-way into said marking material reservoir, and still further such that a final set of electrodes in each said marking material delivery region is adjacent the body to allow electric fields that originate from a terminal electrode of a second set to extend at least part-way into one of said channels;

whereby said plurality of sets of electrodes are selectively activatable to thereby selectively generate electric fields which transport marking material from the marking material reservoir through at least one of said ports and into at least one of said channels.

19. The structure of claim 18, wherein each channel has associated therewith at least one marking material delivery region such that marking material may be delivered through said marking material delivery region into said port and in turn into said channel.

20. The structure of claim 18, wherein:

an initial electrode of each said set of electrodes is in electrical communication with each initial electrode of each of the other of said plurality of sets of electrodes, and further wherein a terminal electrode of each set of electrodes disposed within a first marking material delivery region is in electrical communication with each terminal electrode of each of the other of said plurality of sets of electrodes disposed within said first marking material delivery region but electrically isolated from the electrodes of those sets of electrodes disposed outside said first marking material delivery region;

such that the sets of electrodes in each marking material delivery region form a metering device, each said metering device being independently addressable such that each said metering device may individually control the introduction of marking material from one said marking material reservoir into at least one of said channels.

21. The structure of claim 18, wherein each said marking material delivery region has a width which does not exceed 250 $\mu$m.

22. The structure of claim 21, wherein each of said marking material delivery regions is spaced apart from an adjacent marking material delivery region by no more that 250 $\mu$m.

* * * * *